US008223923B2

(12) United States Patent
Filmer et al.

(10) Patent No.: US 8,223,923 B2
(45) Date of Patent: Jul. 17, 2012

(54) X-RAY SOURCE WITH METAL WIRE CATHODE

(75) Inventors: Bart Filmer, Almelo (NL); Maurice Lambers, Almelo (NL)

(73) Assignee: Panaltyical B.V., Almelo (NL)

( * ) Notice: Subject to any disclaimer, the term of this patent is extended or adjusted under 35 U.S.C. 154(b) by 295 days.

(21) Appl. No.: 12/596,656

(22) PCT Filed: Apr. 18, 2008

(86) PCT No.: PCT/EP2008/054756

§ 371 (c)(1),
(2), (4) Date: Feb. 18, 2010

(87) PCT Pub. No.: WO2008/129006

PCT Pub. Date: Oct. 30, 2008

(65) Prior Publication Data

US 2010/0150315 A1 Jun. 17, 2010

(30) Foreign Application Priority Data

Apr. 20, 2007 (EP) ..... 07106634
Feb. 21, 2008 (EP) ..... 08151763

(51) Int. Cl.
*H01J 35/06* (2006.01)

(52) U.S. Cl. ..... 378/136; 313/341; 313/343; 313/344; 313/345; 313/346 R

(58) Field of Classification Search ..... 378/122, 378/134, 136; 313/341, 343, 344, 345, 346 R
See application file for complete search history.

(56) References Cited

U.S. PATENT DOCUMENTS

| | | | | |
|---|---|---|---|---|
| 1,733,813 | A | 10/1929 | Wesley et al. | |
| 2,014,787 | A | 9/1935 | Smithells et al. | |
| 3,273,005 | A | 9/1966 | Lafferty | |
| 3,312,856 | A | 4/1967 | Lafferty et al. | |
| 4,506,187 | A * | 3/1985 | Hofmann et al. | 313/341 |
| 4,730,353 | A | 3/1988 | Ono et al. | |
| 4,847,534 | A * | 7/1989 | der Kinderen et al. | 313/628 |
| 6,968,039 | B2 * | 11/2005 | Lemaitre et al. | 378/138 |
| 6,980,623 | B2 * | 12/2005 | Dunham et al. | 378/19 |
| 7,133,495 | B2 * | 11/2006 | Nakamura et al. | 378/114 |
| 7,257,194 | B2 * | 8/2007 | Smith | 378/136 |
| 7,271,530 | B2 * | 9/2007 | Kuribayashi et al. | 313/341 |
| 7,327,829 | B2 * | 2/2008 | Chidester | 378/136 |
| 7,333,592 | B2 * | 2/2008 | Nonoguchi et al. | 378/136 |
| 7,352,846 | B2 * | 4/2008 | Kuribayashi et al. | 378/136 |
| 7,657,002 | B2 * | 2/2010 | Burke et al. | 378/136 |

FOREIGN PATENT DOCUMENTS

JP 04-368761 12/1992

* cited by examiner

*Primary Examiner* — Allen C. Ho
(74) *Attorney, Agent, or Firm* — Blakely, Sokoloff, Taylor & Zafman

(57) ABSTRACT

An X-ray source with a cathode (2) that includes a first wire (4) having optionally thermal loops (12, 14) between an emission loop (10) and first and second ends (6, 8). A spiral second wire (30) is wound around the wire (4) and a low work function coating (32) is provided on both wires. The first and second wires may be of refractory material, such as tungsten, and the low work function coating may include barium oxide.

10 Claims, 3 Drawing Sheets

X-RAY SOURCE WITH METAL WIRE CATHODE

This is a non-provisional application claiming the benefit of International application number PCT/EP2008/054756 filed Apr. 18, 2008.

The invention relates to an X-ray source including an X-ray cathode.

X-Rays are frequently generated by an X-ray source, often in the form of a vacuum tube including a cathode and anode. Electrons from the cathode are accelerated towards the anode by a strong electric field and generate X-rays on collision with the anode. These pass out of the X-ray tube through a window, typically of beryllium.

Electrons are emitted by thermionic emission from the cathode by heating the cathode. For high power tubes the cathode may typically be of tungsten, which has the advantage that it is stable at a high temperature (2400K) that is used to achieve sufficient thermionic emission. Even at 2400K tungsten does not melt or deform. At these high temperatures heat radiation is significant and so the cathode can equilibrate effectively by heat radiation.

A description of an existing X-ray tube for X-ray analysis is provided in EP 553 913.

A disadvantage with tungsten cathodes is that significant electrical power is needed to attain and maintain the required high temperature. Significant cooling is also required. Moreover, evaporation can take place at the high temperatures resulting in contamination of the window which in turn reduces X-ray power and may contaminate the X-ray spectrum.

For this reason, there is interest in alternative cathode materials that emit electrons at a lower temperature. To this end, the tungsten cathode may be coated with barium oxide which results in thermionic emission at a lower temperature of 1100K. At these temperatures, evaporation of material is negligible and the electrical power and cooling requirements of the tube are thereby reduced.

However, the barium oxide coating is fragile and can be affected by sputtering from positive ions in the strong electric field. Moreover, at the lower temperature used, there is less heat radiation and so it becomes much more difficult to ensure that all regions of the cathode are at the same temperature. Unequal temperatures in turn can result in uneven X-ray emission which leads to an ill-defined X-ray spot. Further, unequal bonding of the coating to the tungsten wire also results in uneven X-ray emission from the anode. For this reason, as far as the inventors are aware, barium oxide has not been used in high power X-ray tubes for analytical applications.

There thus remains a need for a X-ray source that can operate at relatively low cathode temperatures and high X-ray power.

According to an aspect of the invention there is provided an X-ray source according to claim 1.

By using a cathode with a spiral wire around the emission loop of wire, and an emitter coating on this composition of wires, the contact (i.e. the bonding strength) of the coating to the wire is much improved.

Thermal loops may be provided between the emission loop and the ends of the wire. The temperature of the wire in use is equilibrated much better than when using a simple arrangement without the thermal loops.

The wire may be supported on support loops that may be thinner than the emission loop of wire to avoid excessive heat transfer.

Embodiments of the invention will now be described, purely by way of example, with reference to the accompanying drawings, in which.

Like or similar components are given like reference numerals in different figures, which are schematic and not to scale.

Figure 1:
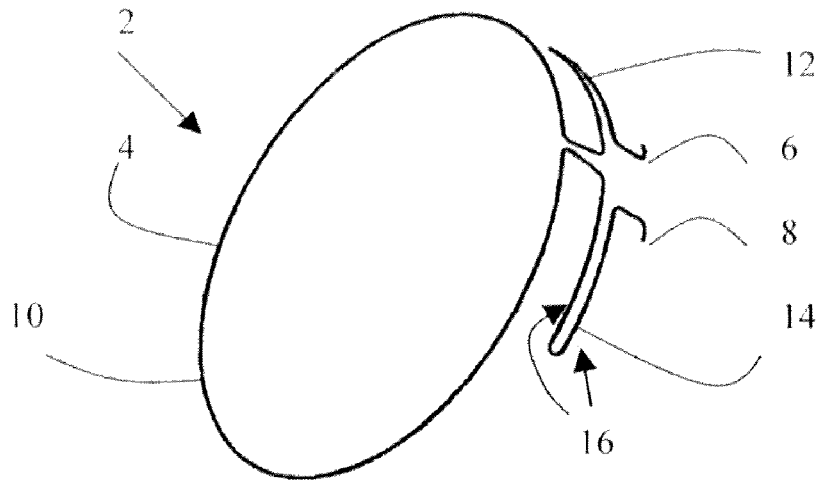
FIG. 1 shows a perspective view of a cathode used in an embodiment of the invention.

Referring to FIG. 1, a cathode 2 for an X-ray tube is shown. The cathode is formed from a single length of tungsten wire 4 extending between a first end 6 and a second end 8 which are arranged adjacently. The cathode has the form of a circular emission loop 10, with first and second thermal loops 12,14 between the emission loop 10 and respective first and second ends 6,8. Each of the first and second thermal loops 12, 14 is formed of a U-shaped loop of wire, the legs 16 of the U extending in parallel to the emission loop, that is to say following the circle. The term "thermal loop" is used since the function of the loop is to provide some thermal resistance between the emission loop 10 and the ends of the wire 6,8.

Figure 2:
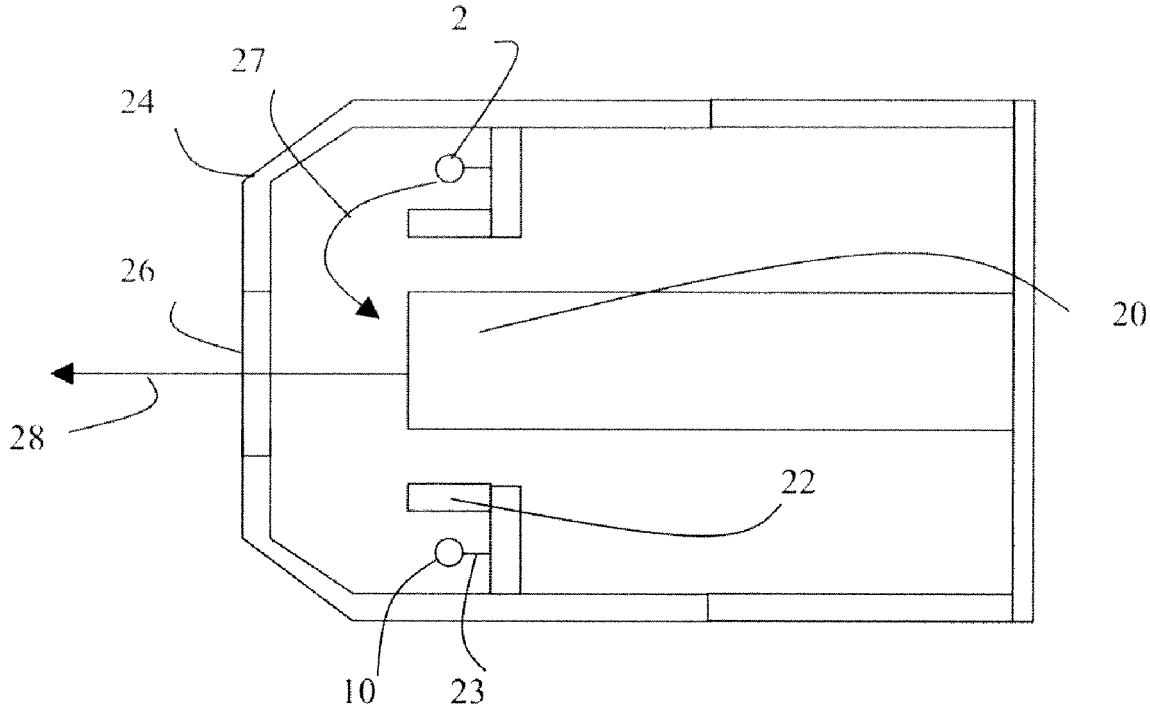
FIG. 2 shows a side view of an X-ray source according to an embodiment, incorporating the cathode of FIG. 1.

Referring to FIG. 2, the cathode 2 is arranged with the emission loop 10 surrounding a central anode 20. A wall 22 extends around the anode 20 between the anode 20 and the cathode 2. The wall 22 acts as an obstacle so that there is no direct straight path between cathode and anode. In the example, the anode surface 20 is of Rhodium but alternative materials may be used if required. The ends 6, 8 of the cathode wire are mounted on a support which is not thermally equilibrated with the emission loop 10 in use.

In addition to the thermal loops, additional thin support wires 23 are used to support the emission loop, arranged evenly spaced around the emission loop. These are selected with a length, thickness and location to realise a homogenous temperature distribution. In particular, the support wires 23 may be made thinner than the tungsten wire 4 so that they do not conduct as much heat per unit area. However, the support wires 23 may be made without thermal loops, and so they have a shorter effective length, so that they pass a similar, low, heat flow per unit time as the thermal loops between emission loop and first and second ends 6, 8. Thus, the support wires 23 may have a thermal resistance within 80% to 120% of the thermal resistance of the thermal loops as a result of this trade off between effective length and thickness.

In this way, a relatively homogenous temperature distribution may be achieved around the full length of the emission loop 10.

The effect of the thermal loops 12, 14 is to thermally decouple the emission loop 10 to the ends 6,8 by increasing the length of wire between the emission loop 10 and the ends 6,8.

The cathode 2 and anode 20 are arranged inside vacuum housing 24 with beryllium window 26 facing the anode 20. The housing 24 is evacuated.

Figure 3:
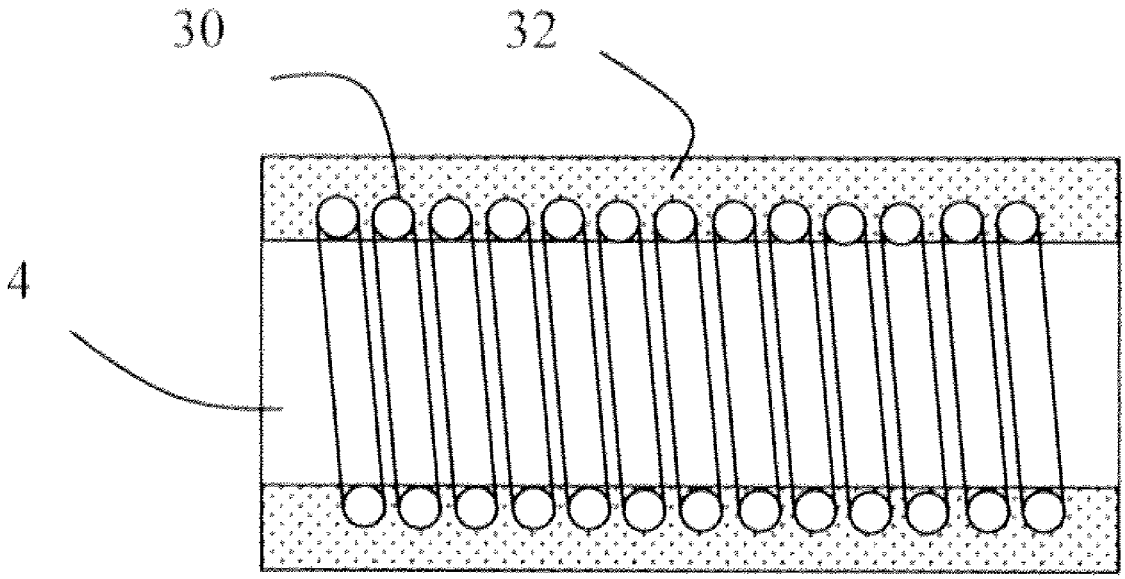
FIG. 3 shows a detail of the cathode of FIG. 1.

FIG. 3 illustrates the fine detail of the tungsten wire 4 of the cathode 2. A second tungsten wire 30 is arranged in a spiral around the first tungsten wire 4. A barium oxide coating 32 is arranged on the composition of wires. In the example, there are small gaps between individual turns of the spiral wire, and the coating 32 extends into these gaps as well as over the surface. This is believed to create a strong bond and good chemical contact between the coating 32 and wires 4, 30.

In the example, the emission loop 10 is a circular loop 38 mm in diameter. Each thermal loop 12, 14 is 30 mm long. The inner tungsten wire 4 has a diameter of 250 μm and the second spiral wire 30 a diameter of 29 μm. The pitch of the spiral is 35 μm in the example, leading to small gaps of (35-29)=6 μm. The thickness of the coating is 10 μm. The emission loop was supported by three support wires 23 which in the example had a diameter of 100 μm and a length of 5 mm.

As those skilled in the art will appreciate, these measurements can be varied. Typically, the emission loop 10 will have a maximum linear dimension, i.e. diameter in the case of a circle, from 1 mm to 500 mm, in typical embodiments from 5 mm to 150 mm. The length of wire may be from 15 mm to 1500 mm, for example. The thermal loops 12,14 may have a length of wire between 2 and 170 mm. The inner wire 4 may have a diameter from 50 μm to 900 μm, and the outer spiral wire 30 from 1 μm to 500 μm. The pitch of the outer spiral wire 30 should be at least the diameter of the outer spiral wire up to 10 times the diameter of the outer spiral wire, preferably up to double the diameter of the outer spiral wire, so for a spiral wire of diameter 29 μm as in the example the pitch is preferably 29 μm to 58 μm. The coating thickness may be from 0.5 μm to 50% of the diameter inner wire. The outer spiral wire may be tightly bound to the inner wire, or may be spaced from it, for example from 0 to 20% of the diameter of the inner wire. The support wire may be, for example, from 20 to 500 μm diameter and any suitable length, for example from 2 mm to 30 mm. The support wire may in particular have a diameter 20% to 80%, or 20% to 50% of that of the inner wire.

The length of each leg of the thermal loops may be 10% to 40% of the length of the emission loop. The emission loop may extend around the anode in the form of a circle, extending at least 300° around the circumference of the circle.

In use, a high voltage is applied between anode 20 and cathode 2. The voltage may be, for example, from 20 to 60 keV; other voltages may be used if required. Preferably, this is done by applying a small positive voltage to the cathode and a large positive voltage to the anode, as set out in EP 608 015. Electrons 27 are thermally emitted by the cathode 2, and hit the anode 20 where they cause X-rays 28 to be emitted. The emitted X-rays pass out through window 26.

The inventors have discovered that the combination of the thermal loops, spiral wire and coating produces highly desirable results.

The use of BaO allows thermionic emission at a lower temperature than prior art tungsten cathodes. The way in which the BaO is formed on the second tungsten wire spiral increases the stability of the BaO. Note that in the example tested the coating is a mixture of 50% BaO and 50% SrO; the BaO is responsible for the low temperature emission and for this reason the coating is referred to as a BaO coating.

Figure 4:
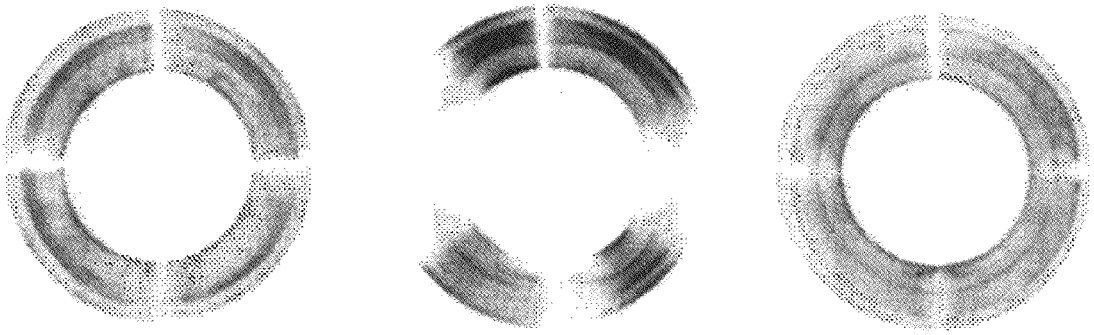
FIG. 4 illustrates the X-ray spot of a cathode according to FIG. 1 and two comparative examples.

The inventors have tested the cathode according to the invention, an alternative BaO cathode in which a BaO coating is applied directly to the tungsten wire, and a tungsten cathode without a BaO coating. The X-ray spot has been imaged. FIG. 4 illustrates these three cases—the left image is from a tungsten cathode, the middle image from the alternative BaO cathode and the right image from the invention.

It will be seen that the cathode according to the invention delivers a very even X-ray spot, because of the even temperature distribution and good bonding between the coating and the coiled wire. In contrast, a conventional X-ray cathode with a BaO coating produces an uneven spot with part of the spot missing which would give poorer results.

Figure 5:
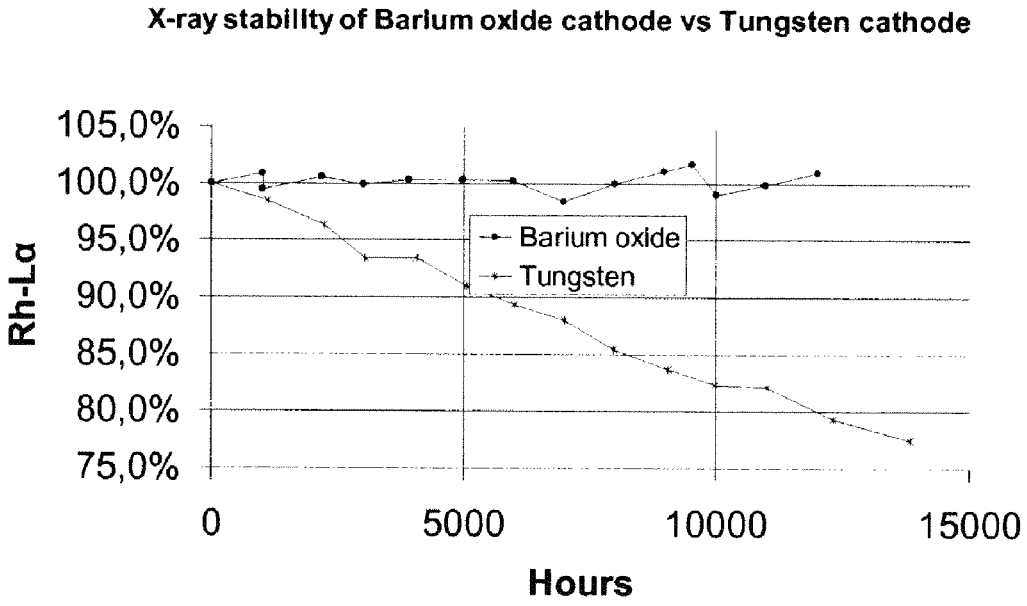
FIG. 5 is a graph of X-ray output over time for the cathode of FIG. 1 and a comparative example.

Further, the lifetime of the cathode according to the invention is considerably longer than a conventional tungsten cathode. The absence of tungsten evaporation results in a stable X-ray output over time. FIG. 5 illustrates the X-ray output of a tube according to the invention (top line) and the existing tube with a tungsten cathode.

Although the description of the embodiment of the invention describes the use of tungsten for both the inner wire 4 and the spiral wire 30, alternative materials may also be used, including platinum, rhenium, nickel, molybdenum, iridium, platinum, tantalum, palladium, niobium, osmium or hafnium and other refractory materials. The material used may also be combinations and/or alloys of such metals.

Also, barium oxide is not the only low temperature X-ray emitter, but yttrium oxide, lanthanum hexaborate ($LaB_6$), $ThB_4$, doped tungsten, doped barium oxide and mixtures, carbon nanotubes and other materials with work functions below 4 eV may also be used. Such materials may be represented by formulae such as $LaB_x$, i.e. a non-stochiometric formula. The emitter coating may also include fillers such as calcium oxide, strontium oxide, aluminium oxide or silicon oxide.

As well as a circle, the emission loop can have other forms, such as line, rectangular or oval, or a "hairpin" shape, a long "U" shape.

The specific arrangement with a ring, a cathode and anode is also optional and the anode can also, for example, be arranged facing the cathode or indeed in other configurations.

By "X-ray source" any source of X-rays is intended, whether or not it includes a sealed tube.

The invention claimed is:

1. An X-ray source comprising:

an anode;

a cathode having an emission loop surrounding the anode; and wherein the emission loop includes:

a first wire of refractory metal extending between a first end and a second end;

a spiral of a second wire of refractory metal extending around and covering the first wire at least over the length of the emission loop; and a coating covering the first and second wires at least over the length of the emission loop, the coating having a work function below 4 eV;

wherein the first wire of refractory metal includes a first thermal loop between the emission loop and the first end, and a second thermal loop between the emission loop and the second end, wherein each thermal loop provides a thermal resistance between the emission loop and the respective end.

2. An X-ray source according to claim 1 wherein each of the first and second thermal loops comprises a pair of loop elements extending parallel to the emission loop.

3. An X-ray source according to claim 2, wherein the length of each of the pair of loop elements of the thermal loops is 10% to 40% of the length of the length of the emission loop.

4. An X-ray source according to claim 1, further comprising at least one support wire supporting the emission loop, wherein the support wire is thinner than the first wire to have a lower heat conductivity.

5. An X-ray source according to claim 4 wherein at least one support wire has a diameter in the range 10% to 80% of the diameter of the first wire.

6. An X-ray source according to claim 1, further comprising a ring with a wall xtending circumferentially around the anode between the anode and the cathode to avoid a direct straight path between the anode and the cathode.

7. An X-ray source according to claim 1, wherein the coating on the first and second wires comprises an oxide or a metal film of at least one of barium, yttrium, thorium, osmium, ruthenium, or scandium, or $ThB_x$, $Ba_xSc_yO_z$, $LaB_x$.

8. An X-ray source according to claim 7, wherein the coating on the first and second wires comprises BaO.

9. An X-ray source according to claim 1 wherein the first and second ends of the cathode are adjacent.

10. An X-ray source according to claim 1 wherein the first and second wires of the cathode are of tungsten.

* * * * *

UNITED STATES PATENT AND TRADEMARK OFFICE

CERTIFICATE OF CORRECTION

PATENT NO. : 8,223,923 B2
APPLICATION NO. : 12/596656
DATED : July 17, 2012
INVENTOR(S) : Bart Filmer and Maurice Lambers It is certified that error appears in the above-identified patent and that said Letters Patent is hereby corrected as shown below:

In the Claims, Column 4, Claim 6, line 65, delete “xtending” and insert --extending--.

Signed and Sealed this
Twenty-fifth Day of September, 2012

David J. Kappos

David J. Kappos
*Director of the United States Patent and Trademark Office*